United States Patent [19]

Bertani

[11] Patent Number: 4,937,432

[45] Date of Patent: Jun. 26, 1990

[54] APPARATUS TO DELIVER HOT AIR

[75] Inventor: Carlo Bertani, Montechiarugolo, Italy

[73] Assignee: MO-EL S.r.l., Reggio Emilia, Italy

[21] Appl. No.: 300,953

[22] Filed: Jan. 23, 1989

[30] Foreign Application Priority Data

Feb. 4, 1988 [IT] Italy ..... 20586/88[U]
May 4, 1988 [IT] Italy ..... 21188/88[U]

[51] Int. Cl.[5] ..... F26B 19/00; A45D 20/16; F24H 3/02; A47K 10/48

[52] U.S. Cl. ..... 219/364; 200/52 R; 219/369

[58] Field of Search ..... 219/364, 370, 366, 367, 219/373; 200/52 R; 34/96, 97, 243 R

[56] References Cited

U.S. PATENT DOCUMENTS 1,466,093 8/1923 Erb ..... 219/373
2,859,535 11/1958 Carlson ..... 34/243 R
4,594,797 6/1986 Houck, Jr. ..... 34/243 R
4,642,909 2/1987 Garcia ..... 219/373
4,700,049 10/1987 Rubin ..... 219/364
4,735,002 4/1988 Rath ..... 219/370

FOREIGN PATENT DOCUMENTS 2136291 9/1984 United Kingdom ..... 219/370

*Primary Examiner*—A. D. Pellinen
*Assistant Examiner*—Geoffrey S. Evans
*Attorney, Agent, or Firm*—Laff, Whitesel, Conte & Saret

[57] ABSTRACT

The apparatus comprises a protection casing (2) fixable to a wall (3) and housing an air-delivery unit (4). The protection casing (2) has a base portion (6) from the upper part of which a dome-shaped portion (8) projects, and two side portions (9) extending parallelly from the lower part of the dome-shaped portion. The air delivery unit (4) is located between the dome-shaped portion (8) and the side portions (9) and is oscillatably engaged with respect to the casing to be displaced from a non-use position to a use position. When in its use position, the air delivery unit (4) is switched on upon command of a pushbutton (5) housed in the casing (2) and operated by the delivery unit itself.

10 Claims, 3 Drawing Sheets

APPARATUS TO DELIVER HOT AIR

BACKGROUND OF THE INVENTION

1. Field of the Invention

The present invention relates to an apparatus to deliver hot air, of the type comprising a protection casing to be fixed to a wall, an air delivery unit electrically operated and housed in the protection casing and at least a pushbutton to actuate the delivery unit.

In greater detail, the apparatus in question is particularly adapted to be used as hair or hand drier in public and private use utility premises, such as dressing rooms and showers in gymnasiums, swimming pools and the like, bathrooms in hotels, restaurants, private houses and so on.

2. Prior Art

It is known that in premises of the above type fixed wall-supported apparatuses are often employed which are designed to deliver hot air for use as either hair driers or hand driers, depending upon the cases.

To this end, these apparatuses substantially comprise a protection casing to be fixed to a wall, in which a hot air delivery unit is housed.

This delivery unit conventionally comprises a tubular or spiral-shaped structure to the opposite ends of which an air inlet and an air outlet are defined which are in communication with the surrounding atmosphere. Housed in the tubular or spiral-shaped structure in consecutive alignment starting from the air inlet, is an impeller, an electric motor to operate the impeller and one or more resistors.

The delivery unit can be electrically actuated by at least a timed switch exposed on the casing surface to be hand-actuated by a user.

Several apparatuses to be used as hair driers are actuated by a lever to which a flexible hose is hung which is connected, at one end thereof, to the outlet of the delivery unit. In greater detail, the apparatus is activated by the disengagement of the hose from the lever and can only be deactivated when the hole is hung back again.

In operation, air is drawn in from the surrounding atmosphere to be vent onto the resistors and, once the latter have heated it, is delivered to the surrounding atmosphere again through the outlet.

Although these apparatuses are quite capable of performing the functions they have been constructed for, it has been found that they have some problems as regards their safety in use, taking into account the fact that they are almost always installed in places having high humidity rates and exposed to water splashings.

More particularly, most of said problems result from the fact that the operating switch is located at the outside of the protection casing and may often be directly touched by the user in order to switch the apparatus on and off.

It is clear that under this situation there it the risk that a short-circuit may happen as the switch contacts can be easily reached by humidity and/or water splashes which can fall on the protection casing. Another danger of short-circuiting is given by the possibility of the delivery unit drawing in water and humidity stored on the protection casing thereby wetting the electrical components housed therein.

In addition to the above dangers there is also the possibility, above all in apparatuses having a metal casing, that the user may undergo electric shocks should be, as it often happens, actuate the switch with wet hands or in the presence of water on the protection casing.

SUMMARY OF THE INVENTION

Under this situation the main object of the present invention is to solve the problems of the known art by providing an apparatus to deliver hot air in which all electrical components are properly protected both from humidity and possible water splashes which may reach the protection casing, so as to ensure a complete safety of use as regards the possibility of short-circuits in operation and the possibility of transmitting electric shocks to the user while he is switching the apparatus on and off.

The foregoing and further objects which will be more apparent in the course of the present description, are substantially attained by an apparatus to delivery hot air, wherein said delivery unit is oscillatably engaged to the protection casing and is movable from a non-use position in which it is deactivated to a use position in which it is actuated upon command of said pushbutton, the latter being located between the delivery unit and an inner or base wall in the casing, to be separated by the delivery unit as a result of the displacement of said delivery unit from its non-use position to its use position.

BRIEF DESCRIPTION OF THE DRAWINGS

Further features and advantages will best be understood from the detailed description of preferred embodiments of an apparatus to deliver hot air in accordance with the present invention, given hereinafter by way of non-limiting example with reference to the accompanying drawings, in which.

DESCRIPTION OF THE PREFERRED EMBODIMENTS

Figure 2:
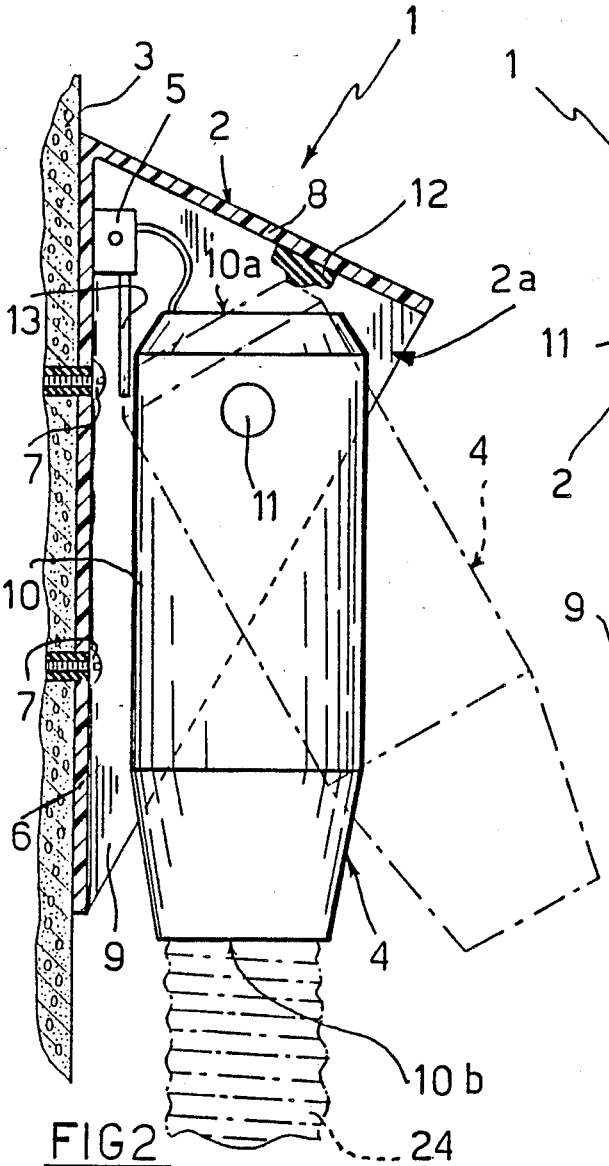
FIG. 2 is a part cross-sectional view of the apparatus taken along line II—II in FIG. 1.

Referring to the drawings, 1 generally denotes an apparatus to deliver hot air according to the invention.

Briefly, apparatus 1 in known manner substantially comprises a protection casing 2 to be fixed to a wall, referenced by 3, a hot air delivery unit 4 housed within the casing 2 and at least a pushbutton 5 to operate the delivery unit 4.

In accordance with the invention, the protection casing 2, preferably made of an electrically insulating plastic material, comprises a base portion or wall 6 designed to allow the fastening of apparatus 1 to a wall 3 by means of nogs 7 or the like. Advantageously, said fastening can also be carried out using a pressure sensitive double-adhesive tape.

The base portion 6 has a substantially rectangular configuration with a rounded upper end from which a dome-shaped portion 8 extends which it downwardly inclined. Extending laterally from the dome-shaped portion 8 are two side portions 9 which prolong their length parallelly downwardly and are connected each to a corresponding edge of the base portion 6; the width of said side portions 9 gradually decreases away from the dome-shaped portion, as clearly shown in FIG. 2.

In known manner, the delivery unit 4 comprises a tubular structure 10 at the opposite ends of which an air inlet and an air outlet identified by reference numerals 10*a* and 10*b* respectively, are defined. Housed in the tubular structure 10, in consecutive alignment starting from the air inlet 10*a*, is an impeller separated by an electric motor and one or more resistors acting close to the air outlet 10*b*. All of the components enclosed in the tubular structure 10 are not shown or further described as known per se and conventional.

Advantageously, the delivery unit 4 is set upright and its air inlet 10*a* is directed upwardly and is exposed on the casing 2 through an open side thereof defined on the opposite side relative to the base portion 6.

Furthermore, in accordance with the invention, the delivery unit 4 is oscillatably connected to the casing 2 so as to be movable from a non-use position in which the delivery unit is deactivated, to a use position in which said unit operates the pushbutton 5 so as to be consequently adjusted upon command of the pushbutton itself.

Figure 1:
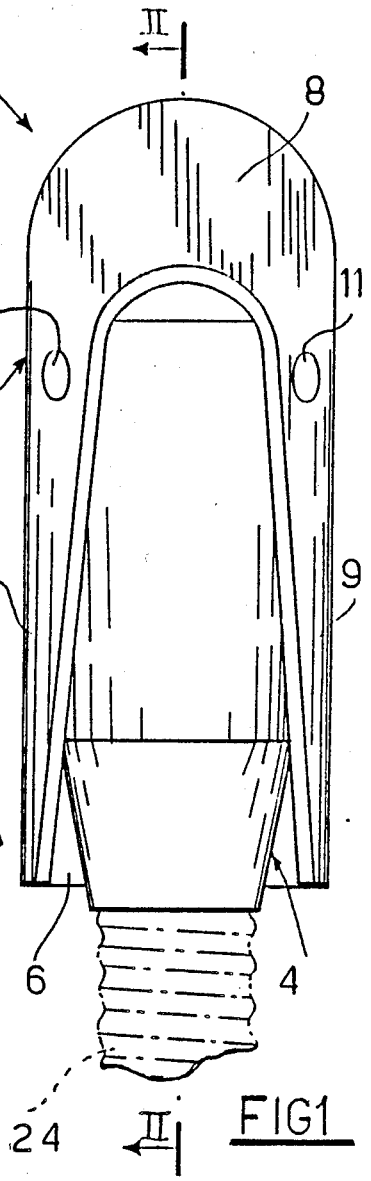
FIG. 1 is a front view of a first embodiment of the invention.

In greater detail, in the embodiment shown in FIGS. 1 and 2 the delivery unit 4 is provided to be rotatably connected to the casing 2 according to a substantially horizontal axis, by means of two pivots 11 rotatably engaging into the side portions 9 of the casing. When the delivery unit 4 iasdisposed in the non-use position it is oriented substantially upright, as shown in solid line in FIG. 2. When the delivery unit 4 is instead disposed in its use position, it has a slanting orientation away from the wall 3, at diagrammatically shown in dotted line in FIG. 2.

Still referring in particular to the embodiment shown in FIGS. 1 and 2, stop means can be advantageously provided to fix the positioning of the delivery unit 4 in its use condition. In the example shown said stop means consists of a peg 12 made of elastically deformable material fastened to the dome-shaped portion 8 of casing 2 and designed to be elastically engaged by the tubular structure of the delivery unit 4 when the latter is brought to its use position. Under this condition the engagement of peg 12 on the surface of the tubular portion 10 brings about a stable positioning of the delivery unit 4 in its use condition. Pegs 12 can be replaced by one or more magnets performing the same function, which are fastened to the casing and act on metal elements secured to the tubular structure 10.

Still in accordance with the invention, the operating pushbutton 5 is advantageously located at the inside of the protection casing 2 so as to be actuated by the delivery unit 4 as a result of the latter moving to its use position. To this end, in the example shown in FIGS. 1 and 2 the pushbutton 5 is secured to the upper part of the base portion (6) immediately under the dome-shaped portion 8 suitably protecting it against possible water splashes and the like and is provided with a drive arm 13 designed to interfere with the movement of the delivery unit 4 to close the pushbutton contacts when the delivery unit it brought to its use position.

Figure 3:
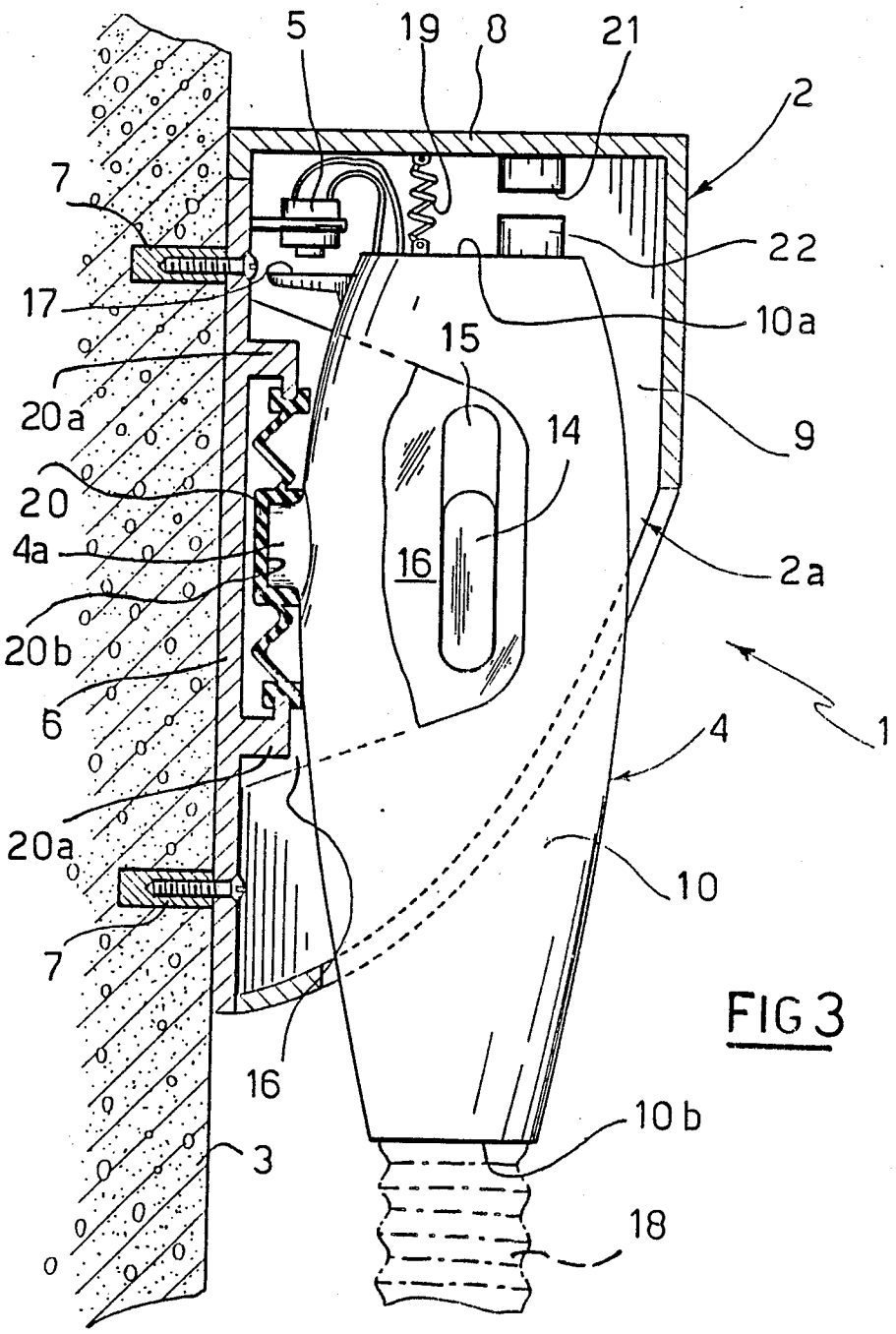
FIG. 3 shows a second embodiment of the apparatus of the invention, partially seen in section.
Figure 4:
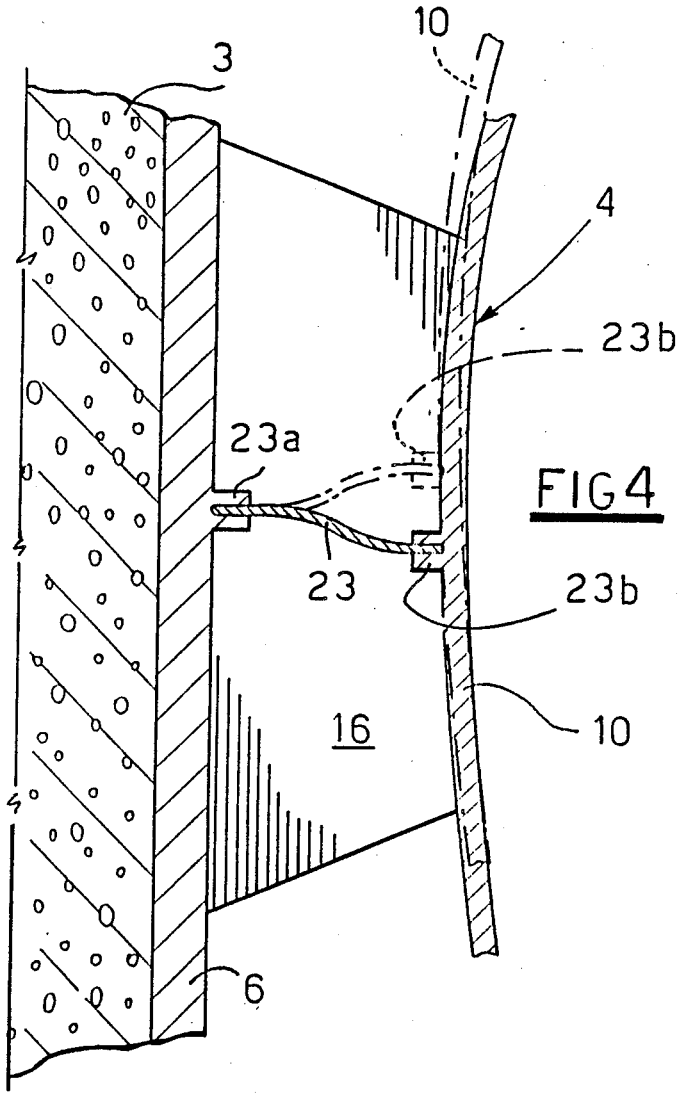
FIG. 4 is a broken away sectional view to an enlarged scale of a variant applied to the apparatus shown in FIG. 3.

Referring now to the embodiments shown in FIGS. 3 and 4, provision is made for the delivery unit 4 to be engaged to the casing 2 so as to be substantially movable in an upright direction to pass from a non-use position to a use position and vice versa. To this end, the tubular structure 10 is provided, on its outer opposite sides, with two projections 14 each slidably guided in a substantially upright slot 15 formed in a flap 16 integral to the base portion 6 of casing 2.

The pushbutton 5 which in this case too is secured to the top base portion 6, is operated by a drive lug 17 integral to the tubular structure 10 and arranged such as to close the contacts of the pushbutton itself when the delivery unit 4 moves to its operating position carrying out a slight lifting displacement.

The embodiments shown in FIGS. 3 and 4 are provided with positioning means as well, to selectively retain the delivery unit 4 in its non-use position and use position.

In the embodiment shown in FIG. 3 wherein the apparatus 1 is adapted to be used as hair drier, said positioning means consists of the combination of at least a return spring and a flexible hose 18 shown in dotted line, the weight of the latter being higher than the lifting force of the return spring. The return spring may for example be a helical spring 19 one end of which is engaged with the upper portion 8 of the protection casing 2, the opposite end being engaged with the tubular structure 10 of the delivery unit 4.

In addition to or in place of the helical spring 19, provision may be made for an elastic bearing, identified by 20 in FIG. 3, supported by a fastening portion 20*a* integral to the base portion 6 of the protection casing 2. The elastic bearing 20 incorporates a seat 20*b* inside which a projecting portion 4*a* of the delivery unit 4 engages. The elastic bearing 20 is made of rubber or another elastomeric material.

In place of the helical spring 19 and/or the elastic bearing 20 it is also possible to provide for the presence of a magnet 21 fastened underneath the upper portion 8 and cooperating with a ferromagnetic element 22 integral to the delivery unit 4.

In the embodiment shown in FIG. 4 where the apparatus 1 is arranged to be used as a hand drier, the flexible hose 18 is not necessary and the positioning means essentially comprises a bistable spring referenced by 23, one end of which is engaged in a seat 23*a* incorporated in the base portion 6, the other end being engaged in a further seat 23*b* incorporated in the tubular structure 10. The bistable spring 23 retains the delivery unit 4 in its non-use and use positions respectively.

Operation of the apparatus according to the invention described above mainly as regards structure, is very simple.

When apparatus 1 is not used, the delivery unit 4 is oriented in the non-use position. Under this situation the contacts of the pushbutton 5 are open and the delivery unit 4 is inactive.

Referring to the embodiment of FIGS. 1 and 2, to cause the activation of the delivery unit 4 it is sufficient to slightly rotate the latter about pivots 11 so as to dispose it in its use position. In fact, under this situation the displacement of the drive arm 13 carried out by the tubular structure 10 causes the closure of the pushbutton contacts and, as a result, the desired actuation of the delivery unit 4.

When the delivery unit 4 is in operation, the impeller therein provided causes air to be drawn in through the air inlet 10*a*. The drawn-in air is taken from the surrounding atmosphere through the hollow spaces existing between the delivery unit 4 and protection casing 2, as well as, optionally, through slits suitably formed in the side portions 9 of said casing.

The air drawn in through the air inlet 10*a* is heated at the inside of the tubular structure 10 and delivered to the atmosphere through the air outlet 10*b*.

Should the apparatus 1 of FIGS. 1 and 2 be used as a hand drier, the orientation of the delivery unit 4 in its non-use position and use position will be accomplished manually, directly acting on said delivery unit.

When the apparatus 1 as shown in FIGS. 1 and 2 is used as a hair drier, a flexible hose 24 should preferably be combined therewith; said flexible hole 24 partially shown in dotted line, extends from the air outlet 10*b*, and the free end thereof, not shown, can be equipped with several different accessories, such as diffusers, brushes and the like conventionally fastened to casing 2 by suitable hooking means not shown. In this case it will be sufficient to direct said free end of the flexible hose 24 towards the user's head to cause said hose to move apart from wall 3, which brings about the orientation of the delivery unit 4 into its use position and, as a result, the activation of the same upon the action of the pushbutton 5.

When hose 24 is merely released the use of apparatus 1 being no longer necessary, it will automatically come close to wall 3; in fact the weight of said hose overcomes the resistance offered by peg 12 and automatically brings back the delivery unit 4 to its non-use position, causing the deactivation thereof. Advantageously said deactivation, unlike that of known apparatuses, takes place even if the user forgets to hung the free end of hose 24 to the casing 2.

Referring now to the embodiment of FIG. 3, the non-use position of the delivery unit 4 is held as far as the weight of the flexible hole 18 connected to the delivery unit 4 has a higher value than the lifting force of the helical spring 19 and/or elastic bearing 20 and/or magnet 21. In this position the drive lug 17 provided on the tubular structure 10 does not come into contact with the pushbutton 5.

When the user lifts the flexible hose 18 the weight of the latter acting in the delivery unit 4 decreases, which enables the helical spring 19 and/or elastic bearing 20 and/or magnet 21 to bring said delivery unit to its use position.

Simultaneously with this displacement the drive lug 17 closes the contacts of the pushbutton 5 thus operating the delivery unit 4 in the same manner as previously said.

At the end of use of apparatus 1 the user must only put the flexible hose 18 back to its original position in order to reset the initial conditions and automatically cause the deactivation of the delivery unit 4.

In the embodiment shown in FIG. 4 the displacement of the delivery unit 4 from the use position to the non-use position and vice versa is instead achieved by a mere manual action directly carried out on the tubular structure 10.

The present invention attains the intended purposes.

The inventive apparatus is in fact structured so as to perfectly protect all electrical components provided therein against possible water splashes or humidity. It is to be pointed out in this connection that both the operating pushbutton 5 and air inlet 10*a* of the delivery unit 4 are protected by casing 2 and practically cannot be reached by possible water splashes that might fall onto the casing.

In addition, since the pushbutton 5 is activated by merely displaying the delivery unit 4, the user is no longer compelled to act directly on said pushbutton to control the apparatus operation. On the contrary, the switching on and off of the apparatus is achieved directly acting on the tubular structure 10 or flexible hose 18, 24, that is to say on elements made of electrically insulating material and located rather far from the pushbutton 5.

Obviously the present invention is susceptible of many modifications and variations, all falling within the scope of the inventive idea characterizing it.

What is claimed is:

1. An apparatus to deliver hot air comprising: a protection casing to be fixed to a wall; a hot air delivery unit electrically operated and housed in the protection casing;

at least a pushbutton to actuate the delivery unit, wherein said delivery unit is oscillatably engaged to the casing and is movable from a non-use position in which it is deactivated, to use a position in which it is actuated upon command of said pushbutton which is located between the delivery unit and a base portion or wall of the casing, to be operated by the delivery unit as a result of the displacement of the latter from its non-use position to its use position, the delivery unit is rotatably connected to the protection casing according to a substantially horizontal axis, and is arranged so as to be oriented, in its non-use and use positions respectively, according to a substantially upright axis and to a vertically-slanting direction away from said wall, comprising stop means (12) acting between the delivery unit (4) and casing (2) to fix the delivery unit (4) in its use position.

2. The apparatus as claimed in claim 1, wherein said stop means comprises a peg (12) made of elastically deformable material, secured to the dome-shaped portion of the casing (2) and designed to be elastically engaged by said delivery unit (4) when the latter is brought to its use position.

3. An apparatus to deliver hot air comprising:

a protection casing to be fixed to a wall;

a hot air delivery unit electrically operated and housed in the protection casing, said delivery unit is slidably engaged in the protection casing, positioning means being provided to selectively retain the delivery unit in its non-use and use positions wherein said delivery unit is oscillatably engaged to the casing and is movable from a non-use position in which it is deactivated, to a use position in which it is actuated upon command of at least a pushbutton which is located between the delivery unit and a base portion or wall of the casing, to be operated by the delivery unit as a result of the displacement of the latter from its non-use position to its use position.

4. The apparatus at claimed in claim 3, wherein said delivery unit (4) comprises two side projections (14) guided in a substantially vertical direction within respective slots (15) formed in two flaps (16) integral to the protection casing (2).

5. The apparatus at claimed in claim 3, wherein said positioning means comprises the combination of at least a return spring (19, 20) acting between the protection casing (2) and the delivery unit (4), and a flexible hose (18) connected to the delivery unit (4), the weight of said hose applied to the delivery unit (4) being greater than the force exerted by said return spring (19, 20) on the delivery unit itself in order to allow the latter to take its use position as a result of the lifting of said flexible hose (18) by the user.

6. The apparatus at claimed in claim 5, wherein said return spring consists of a helical spring (19) one end of which is engaged with an inner wall of said protection casing (2), the opposite end being engaged with said delivery unit (4).

7. The apparatus as claimed in claim 5, wherein said return spring consists of an elastic bearing (20) supported by a fastening portion (20*a*) integral to an inner wall of the protection casing (2), said elastic bearing (20) incorporating a seat (20*b*) engaged with a projecting portion (4*a*) of the delivery unit (4).

8. The apparatus as claimed in claim 3, wherein said positioning means comprises the combination of at least a magnet (21, 22) acting between the upper portion (8) of the protection casing (2) and the delivery unit (4), and a flexible hose (18) connected to the delivery unit, the weight of said hose applied to the delivery unit being greater than the force exerted by said magnet (21, 22) on the delivery unit so that the latter may take its use position as a result of the lifting of said flexible hose (18) by the user.

9. The apparatus at claimed in claim 3, wherein said positioning means comprises at least a bistable spring (23) one end of which is engaged with an inner wall of the protection casing (2), the opposite end being engaged with said delivery unit (4).

10. A hot air delivery apparatus comprising a protection casing (2) formed with a base portion (6) to be fixed to a supporting wall (3), an upper portion (8) frontally extending from the top of said base portion (6), two side portions or flaps (9,16) extending from the lower part of said upper portion (8) on the opposite sides thereof and a lower opening (2*a*) located between said side portions (9,16); a hot air delivery unit (4) electrically operated and mounted within said casing (2) between said two side portions (9,16); a flexible hose (18,24) mounted in a hanging down condition on said delivery unit (4); at least a push button switch (5) mounted inside said casing (2) on said base portion (6), wherein said delivery unit (4) is mounted so that it is movable on said two side portions (9,16) and said push button switch (5) is mounted on said base portion (6) immediately below said upper portion (8) so as to be actuated by said delivery unit (4) as a result of the displacement carried out by the latter when said flexible house (18,24) is grasped by a user and moved from its hanging down position.

* * * * *